US008096527B2

(12) United States Patent
Naijiang et al.

(10) Patent No.: US 8,096,527 B2
(45) Date of Patent: Jan. 17, 2012

(54) EXTENSION ROD USED FOR A JACK ARM

(75) Inventors: Xu Naijiang, Nanjing (CN); Ge Zhenhong, Nanjing (CN); Matthew Ryan Harmon, Dearborn, MI (US); Jainpin Cai, Jiangsu Province (CN); Yaoxin Zhang, Jiangsu Province (CN)

(73) Assignee: Ford Global Technologies, LLC, Dearborn, MI (US)

( * ) Notice: Subject to any disclaimer, the term of this patent is extended or adjusted under 35 U.S.C. 154(b) by 726 days.

(21) Appl. No.: 12/179,655

(22) Filed: Jul. 25, 2008

(65) Prior Publication Data

US 2009/0026428 A1 Jan. 29, 2009

(30) Foreign Application Priority Data

Jul. 27, 2007 (CN) ..... 2007 2 0126743 U

(51) Int. Cl.
*B66F 3/00* (2006.01)

(52) U.S. Cl. ..... 254/133 R; 254/131

(58) Field of Classification Search ..... 254/133 R, 254/DIG. 3, 134, 131; 280/769; 16/422
See application file for complete search history.

(56) References Cited

U.S. PATENT DOCUMENTS

| | | | | |
|---|---|---|---|---|
| 1,531,732 | A | 3/1925 | Burkholder | |
| 1,810,715 | A * | 6/1931 | Larson et al. | 74/546 |
| 2,254,085 | A | 8/1941 | Nilson | |
| 2,594,605 | A | 4/1952 | Zoppelt | |
| 3,712,652 | A * | 1/1973 | Uilkema | 403/108 |
| 4,528,998 | A | 7/1985 | Gamm | |
| 4,607,406 | A | 8/1986 | Davis, Jr. | |
| 4,765,009 | A * | 8/1988 | Hung | 7/100 |
| 4,826,486 | A * | 5/1989 | Palsrok et al. | 604/174 |
| 5,237,890 | A * | 8/1993 | Gill | 74/546 |
| 5,381,707 | A * | 1/1995 | Gill | 74/546 |
| 5,878,627 | A | 3/1999 | McMurtrey | |
| 5,911,798 | A | 6/1999 | Arnold | |
| 6,070,491 | A | 6/2000 | Claudio et al. | |
| 6,076,424 | A | 6/2000 | McMurtrey et al. | |
| 6,626,423 | B2 | 9/2003 | Doswell | |
| 6,637,908 | B1 | 10/2003 | Hung | |
| 7,086,664 | B2 | 8/2006 | Voegeli, Jr. et al. | |
| 2009/0026428 | A1 * | 1/2009 | Naijiang et al. | 254/133 R |

* cited by examiner

*Primary Examiner* — Lee D Wilson
(74) *Attorney, Agent, or Firm* — O'Brien Jones PLLC

(57) ABSTRACT

An extension rod for a jack arm comprises a connecting rod having a first joint and a second joint formed at the respective ends of the connecting rod. A first locking hole and a second locking hole are formed in the first and second joints, respectively. The extension rod also comprises a lockup mechanism comprising an elastic body configured to connect to either the first joint or the connecting rod and a lockup bolt formed on the elastic body, and configured to engage the first locking hole.

10 Claims, 7 Drawing Sheets

EXTENSION ROD USED FOR A JACK ARM

This application claims benefit of Chinese Application No. 200720126743.9, filed on Jul. 27, 2007 and is incorporated herein by reference in its entirety.

FIELD OF INVENTION

The present invention relates generally to hardware tools. More particularly, the present invention is an extension rod used for a jack arm.

BACKGROUND ART

As shown in FIG. 8, an element, customarily called an arm, is indicated as 3, and is used for operating a jack (for example a scissor jack). At one end of the arm 3 is formed an arm hook 31, which hooks to the hook eye 511 of a screw head 51 of a jack 5, while the other end of the arm 3 is formed into a rectangular structure normally referred to as the rectangular joint. When a jack is to be operated, the arm hook 31 of the arm 3 is hooked up with the hook eye 511 on the screw head 51 and a handle bar 4 is secured on the rectangular joint through a hole formed in the middle of the handle bar. When the handle bar 4 is turned either clockwise or counterclockwise, the arm 3 and the screw of the jack 5 both turn accordingly so as to lift the jack 5 or restore it to its lowered position. Although the structure of the arm 3 meets the needs of operation of the jack 5, the length of the arm 3 is so limited that the operator has to adopt a squatting position to operate the device. As a result, operation efficiency is poor and thus it is easy for the operator to become fatigued. On the other hand, if the arm 3 is made longer to enable the operator to stand while operating, a new problem is created in that the arm 3 will be too long for easy storage. Particularly, the arm 3 and the rest of the jack is a tool set used in conjunction with and carried in an automobile. Thus convenient storage is an important factor that cannot be neglected.

SUMMARY OF THE INVENTION

An object of the present invention is to provide an extension rod for the arm of a jack which helps increase the speed of jack operation, relieves the working intensity of the operator, and can be easily stored. The object of the present invention is accomplished in the following way. An extension rod for the arm of a jack comprises a connecting rod with a first joint and a second joint formed at the respective end of the connecting rod, a first locking hole and a second locking hole formed on the first and second joints respectively, and a lockup mechanism of the connecting rod, which includes an elastic body used for connecting to either the first joint or the connecting rod and a lockup bolt formed on the elastic body and corresponding to the first locking hole.

The sectional shape of both the first joint and the second joint of the present invention is rectangular.

The diameter of said first joint of the present invention is larger than that of the second joint.

The two said locking holes of the present invention are round holes.

The elastic body of the present invention is made of a spring steel sheet which is bent into a general clip shape, with the pair of first and second clipping arms capable of pressing upon the two side walls of the first joint, and the lockup bolt extending from the middle of the upper part of the elastic body and being insertable into said first locking hole.

The elastic body of the present invention is made of spring steel wire which is bent into a clip shape, with the pair of first and second clipping arms capable of pressing upon the two side walls of the first joint, and the lockup bolt formed by bending the wire in the middle of the upper part of the elastic body and being insertable into the first locking hole.

The elastic body of the present invention is made of a spring steel sheet shaped like a "T", with the base part of the "T" capable of firmly holding the connecting rod, and the lockup bolt extending from the front end of the "T" and being insertable into the first locking hole.

The elastic body of the present invention is made of spring steel wire which is bent into a clip shape, with the ends of its first and second clipping arms pivotably fixed on the connecting rod, and the lockup bolt formed by bending at the front end of the elastic body and corresponding to the first locking hole.

The elastic body of the present invention is made of spring steel wire, with the rear end of the spring steel wire fixed on the connecting rod and the front end as a free end; and the lockup bolt, in the form of a butterfly screw, is connected to said free end and insertable into the first locking hole.

Because of the adoption of the above structures, the present invention can be connected as desired with the arm of the jack so as to extend the length of the arm, and it also enables the operator to operate in a standing pose and therefore improves the working efficiency. Because the structure of the connecting rod can be assembled and disassembled easily, the present invention is convenient for storage.

DETAILED DESCRIPTION OF PREFERRED EMBODIMENTS

Embodiment 1

Figure 1:
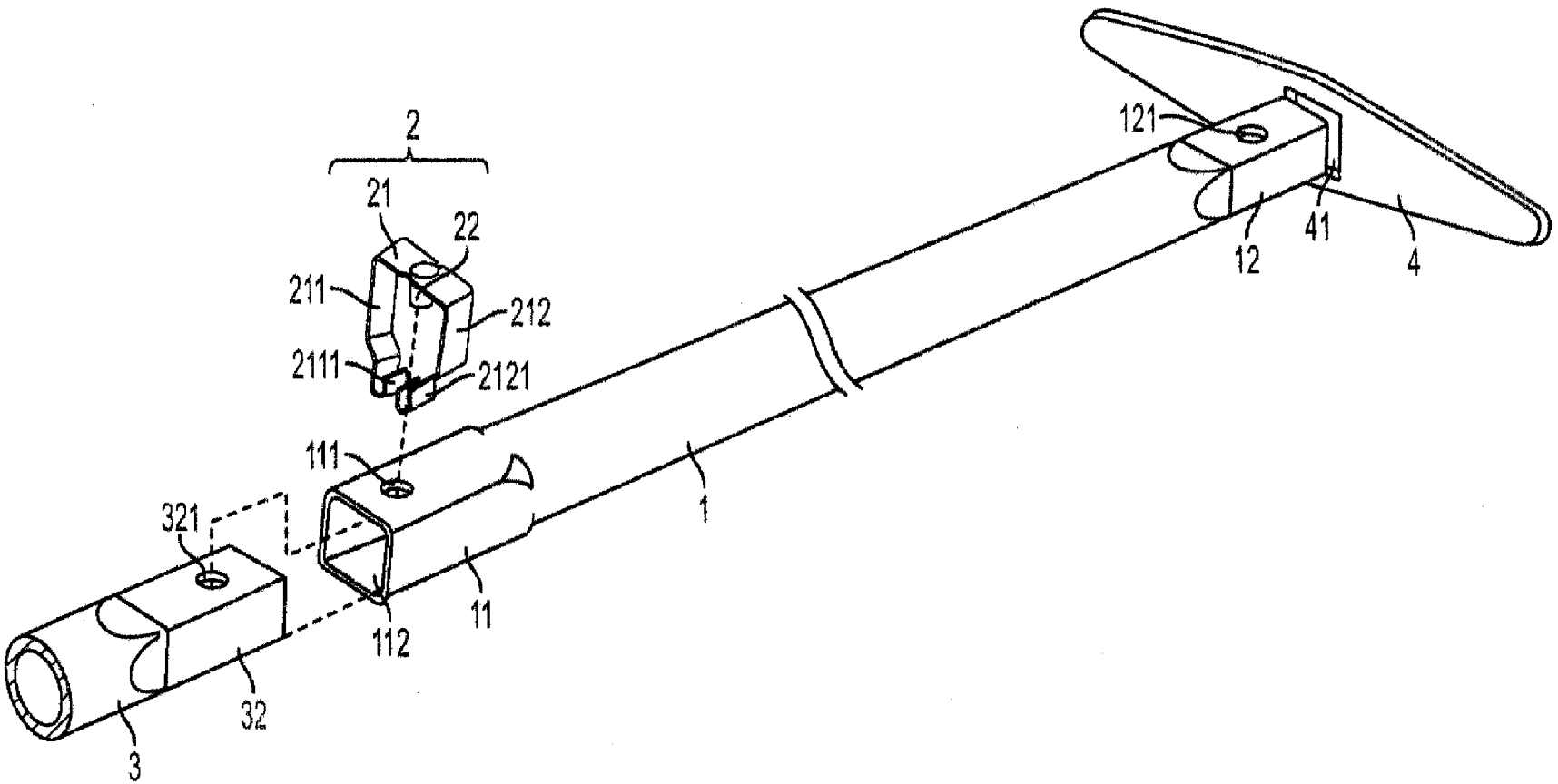
FIG. 1 shows the first embodiment of the present invention.

FIG. 1 shows the connecting rod 1, of which the middle part is cylindrical, and the two ends have a rectangular section. Referring to the embodiment illustrated in FIG. 1, for example, the connecting rod 1 is formed respectively on the first joint 11 and the second joint 12 which are rectangular shaped. At the left and right ends of the connecting rod are the first locking hole 111 and the second locking hole 121. The preferred shape of the first locking hole 111 and the second locking hole 121 is circular, the size of which should be large enough for the lockup bolt 22 of the lockup mechanism 2 of the connecting rod, which will be described later, to be inserted. The first joint 11 on the left is larger than the second joint 12 on the right. To help understand the present invention, also shown in this figure is the arm 3, which has at its end a rectangular joint 32 to be inserted into and fit in the joint socket 112 of the first joint 11. Formed on the rectangular joint 32 is the third locking hole 321. The size of the rectangular joint 32 should be such that it can fit in the joint socket 112. The joint socket 112 is used to hold the rectangular joint 32, and when the rectangular joint 32 is inserted in the joint socket 112, the third locking hole 321 on the joint should be aligned with the first locking hole 111. At the other end of the arm 3, that is, on the left side of the figure, there is an arm hook, which can be seen and understood by referring to FIG. 6, although it is not shown in this figure. The second locking hole 121 formed on the right end of the connecting rod 1 is used to link and lock another connecting rod 1 for a further extension in a way which is similar to that for the rectangular joint 32 of the arm 3. If the connecting rod 1 shown in the present embodiment is the last one of several desired connections, the operation can get started once the handle bar hole 41 on the handle bar 4 is fitted to the second joint 12.

In this embodiment, the lockup mechanism 2 for the connecting rod as disclosed in the present invention, has an elastic body 21 made of a spring steel sheet which is processed into a general clip shape, that is to say, the elastic body is provided with a pair of elastic clipping arms, i.e. the first clipping arm 211 and the second clipping arm 212, which clamp or clip onto the corresponding side walls of the first joint 11. The lockup bolt 22 can be formed by punching in the middle of the upper part of the elastic body 21, i.e., the spring steel sheet with a punching machine, or by providing a protrusion in a preferred cylindrical shape by means of welding, riveting, etc. onto the middle of the upper part of the elastic body 21, and the lockup bolt 22 is to be inserted into the first locking hole 111.

To insert and lock the rectangular joint 32 of the arm 3 into the joint socket 112, the first clipping arm end 2111 and the second clipping arm end 2121 can be pressed toward the joint 11. This causes angled portions between the clipping arm ends 2111, 2121 and the clipping arms 211, 212 to cam the clipping arms 211, 212 outward and upward so that the lockup bolt 22 moves out of the first locking hole 111. Once the rectangular joint 32 is inserted in place, clipping arm ends 2111, 2121 can be released to return to their original positions, and the lockup bolt 22 will automatically be inserted into the first locking hole 111 and the third locking hole 321 to achieve connection of the connecting rod 1 with the arm 3.

Embodiment 2

Figure 2:
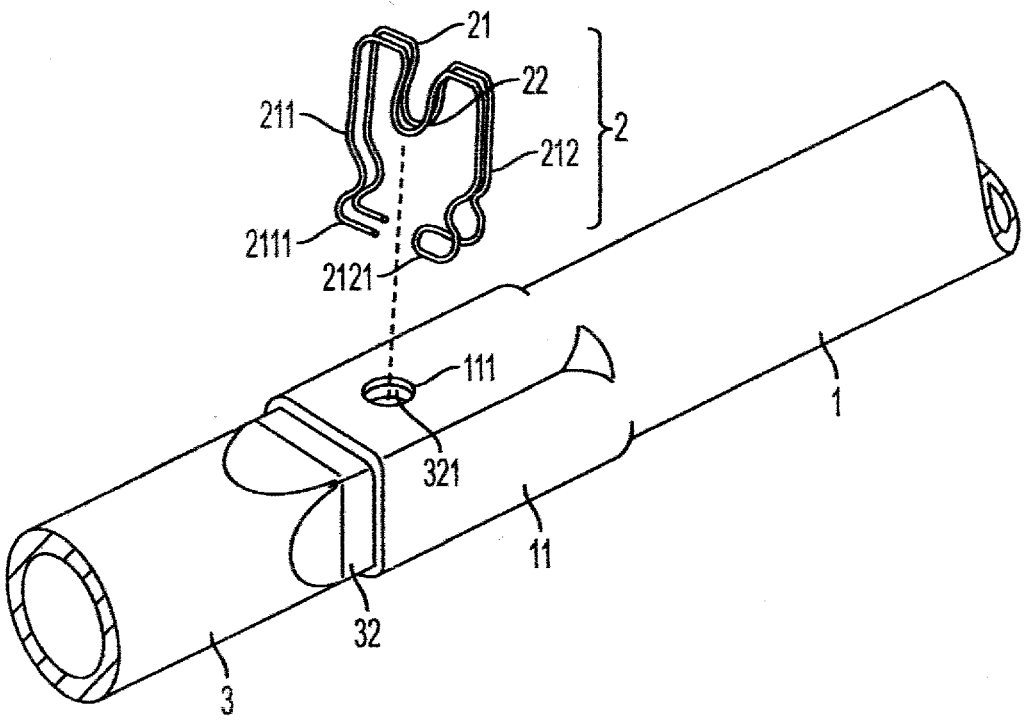
FIG. 2 shows the second embodiment of the present invention.

FIG. 2 shows the lockup mechanism 2 of the connecting rod, which is different from that of Embodiment 1. The elastic body of this lockup mechanism 2 is made of spring steel wire, which is bent into a clip shape that is generally similar to the structure shown in FIG. 1, and the lockup bolt 22 is directly formed out of the spring steel wire. The rest is the same as the description in Embodiment 1.

Embodiment 3

Figure 3:
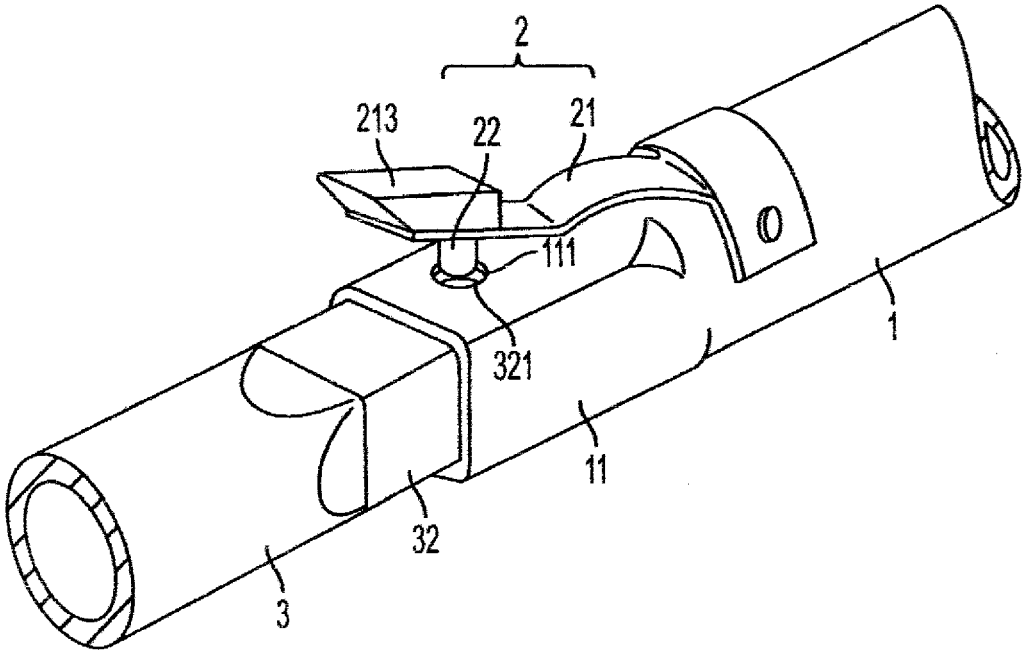
FIG. 3 shows the third embodiment of the present invention.

The elastic body 21 of the lockup mechanism 2 on the connecting rod shown in FIG. 3 is shaped like a "T". This elastic body is processed out of a spring steel sheet, with the two ends of the base part of the spring steel sheet fixed onto the connecting rod 1 by means of welding, riveting, or other similar means, and with the front end of the sheet as a free end extending towards the direction of the first joint 11. A block 213 is provided on the end of the free end, and said lockup bolt 22 is formed at the front end of the "T", i.e., the free end, and is insertable into the first locking hole 111. The lockup mechanism 2 on the connecting rod in this embodiment is different from those in Embodiments 1 and 2, so when the rectangular joint 32 of the arm 3 is inserted into the joint socket 112 of the first joint 11, pull the block 213 with fingers to lift the front end of the elastic body 21 upward to make the lockup bolt 22 move out of the locking hole 111, then release the fingers once the rectangular joint 32 is inserted in place, and at this time, the lockup bolt 22 will, under the counterforce of the elastic body 21, be automatically bolted into the third locking hole 321, and so the connection of the connecting rod 1 with arm 3 is completed. The rest is the same as the description in Embodiment 1.

Embodiment 4

Figure 4:
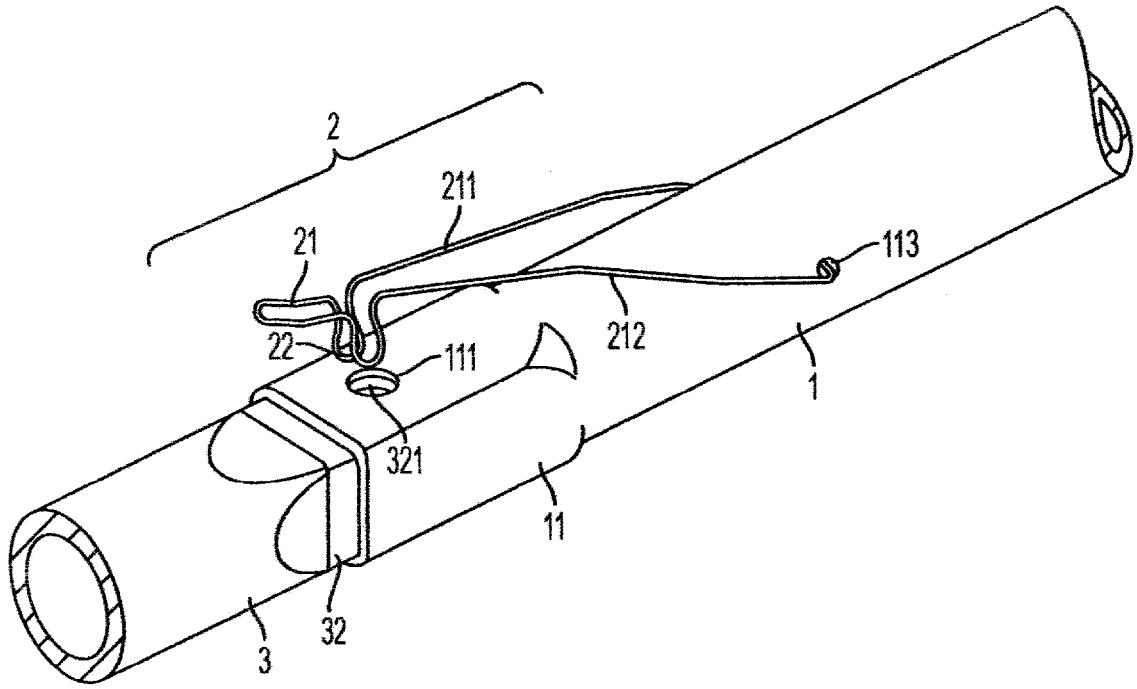
FIG. 4 shows the fourth embodiment of the present invention.

The lockup mechanism 2 on the connecting rod shown in FIG. 4 is also made of spring steel wire which is bent into a mantis-like clip shape, with the tail parts of the pair of clipping arms, i.e., the first clipping arm 211 and the second clipping arm 212 pivotably fixed in pivot holes 113 on the connecting rod 1, and the lockup bolt 22 is directly formed out of the spring steel wire at the front end of the elastic body 21 by means of bending, and is aligned with the first locking hole 111. The rest is similar to the description of Embodiment 1.

Embodiment 5

Figure 5:
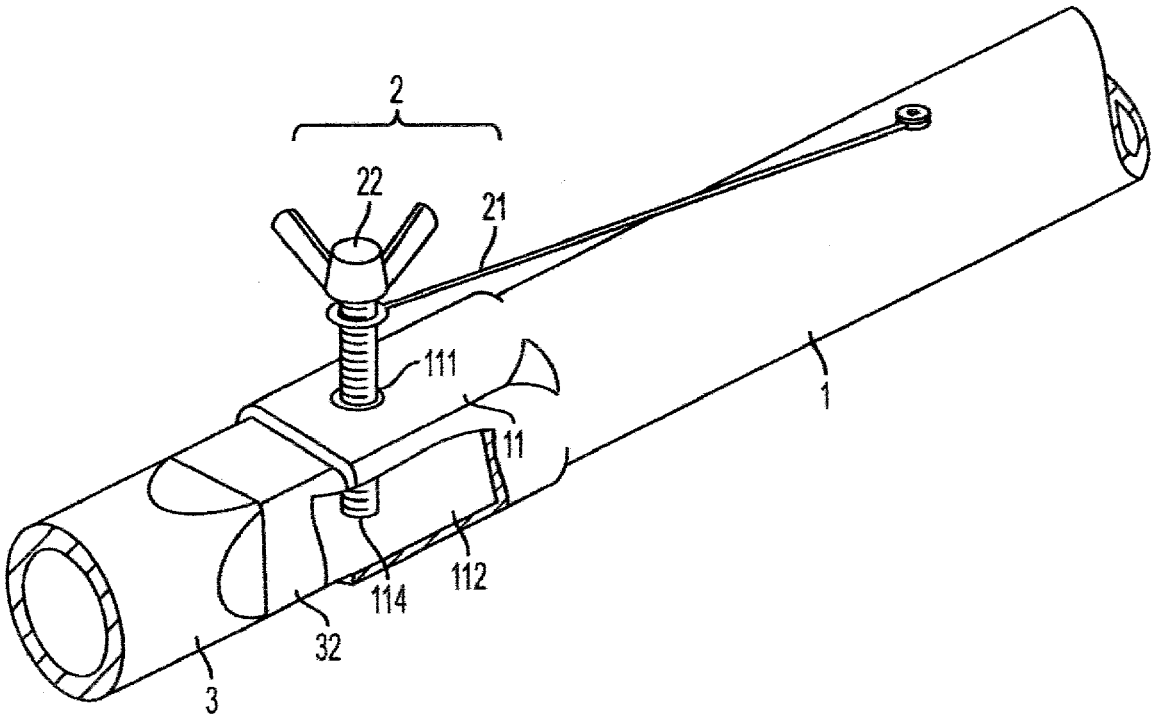
FIG. 5 shows the fifth embodiment of the present invention.

The elastic body 21 of the lockup mechanism 2 of the connecting rod shown in FIG. 5 is a piece of spring steel wire. One end is riveted at R onto the connecting rod 1, and the other end (i.e., the left end as shown in FIG. 5) extends to the first joint 11, and is fixed there with the lockup bolt 22, which, in this embodiment, is a butterfly screw. In order to achieve excellent locking effect of the butterfly screw as a lockup bolt 22 with respect to the arm 3, the first locking hole 111 in the joint socket 112 is threaded to form a threaded hole 114. When the rectangular joint 32 of the arm 3 is inserted in place into the joint socket 112, the butterfly screw is aligned with the first locking hole 111 and the third locking hole 321 (not shown), and then screwed in, until it is screwed into the threaded hole 114 to complete the connection between the connecting rod 1 and arm 3.

Embodiment 6

Figure 6:
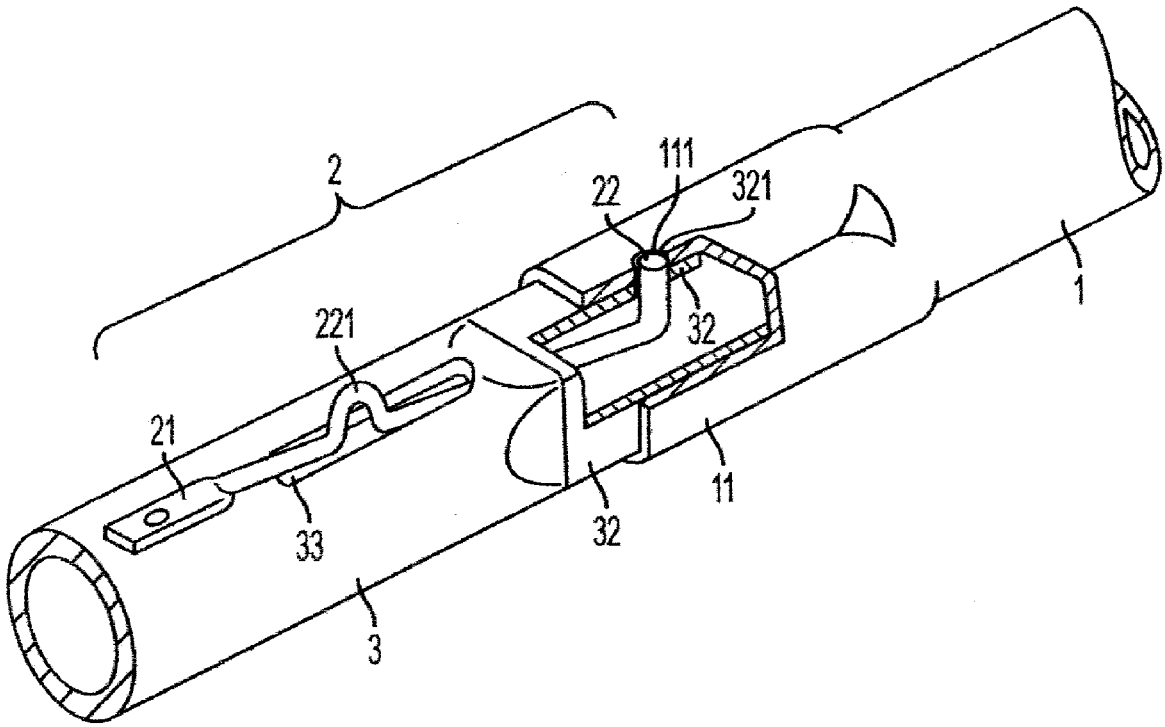
FIG. 6 shows the sixth embodiment of the present invention.

The lockup mechanism 2 of the connecting rod shown in FIG. 6 includes an elastic body 21 and a lockup bolt 22. The elastic body 21 is made of a spring steel sheet, which is riveted to the arm 3. The lockup bolt 22 extends integrally from the other end of the elastic body 21. The approximate middle part of the lockup bolt 22 goes through a slot 33 formed on the arm 3, and its end (i.e., the right end as shown in FIG. 6), is inserted into the third locking hole 321 of the rectangular joint 32 of the arm 3, and as well into the first locking hole 111 formed in the first joint 11 of the connecting rod 1, which aligns with the third locking hole 321. An arched protrusion 221 is formed at the middle part of the lockup bolt 22 corresponding to the slot The lockup mechanism 2 of the connecting rod of the embodiment shown in FIG. 6 is not set up on the connecting rod 1 as in Embodiments 1 through 5, but instead, is formed on the arm 3. The first locking hole 111 is formed on the first joint 11 of the connecting rod 1, thus when the joint socket 112 of the connecting rod 1 is joined with the rectangular joint 32, the lockup bolt 22 will automatically be inserted into the first locking hole 111, and therefore the connection of the arm 3 with the connecting rod 1 is completed. For disconnection, just press the arched protrusion 211 with a hand or a tool, and the lockup bolt 22 will move out of the first locking hole 111, and then the disconnection of the connecting rod 1 and the arm 3 can be completed.

While six embodiments of the present invention have been set forth above, it is understood that there may be other similar variations of the present invention without deviating from the scope of the invention All similar variations are within the scope of the technical solution of the present invention. Therefore, the above embodiments are non-restrictive examples of the present invention.

Figure 7:
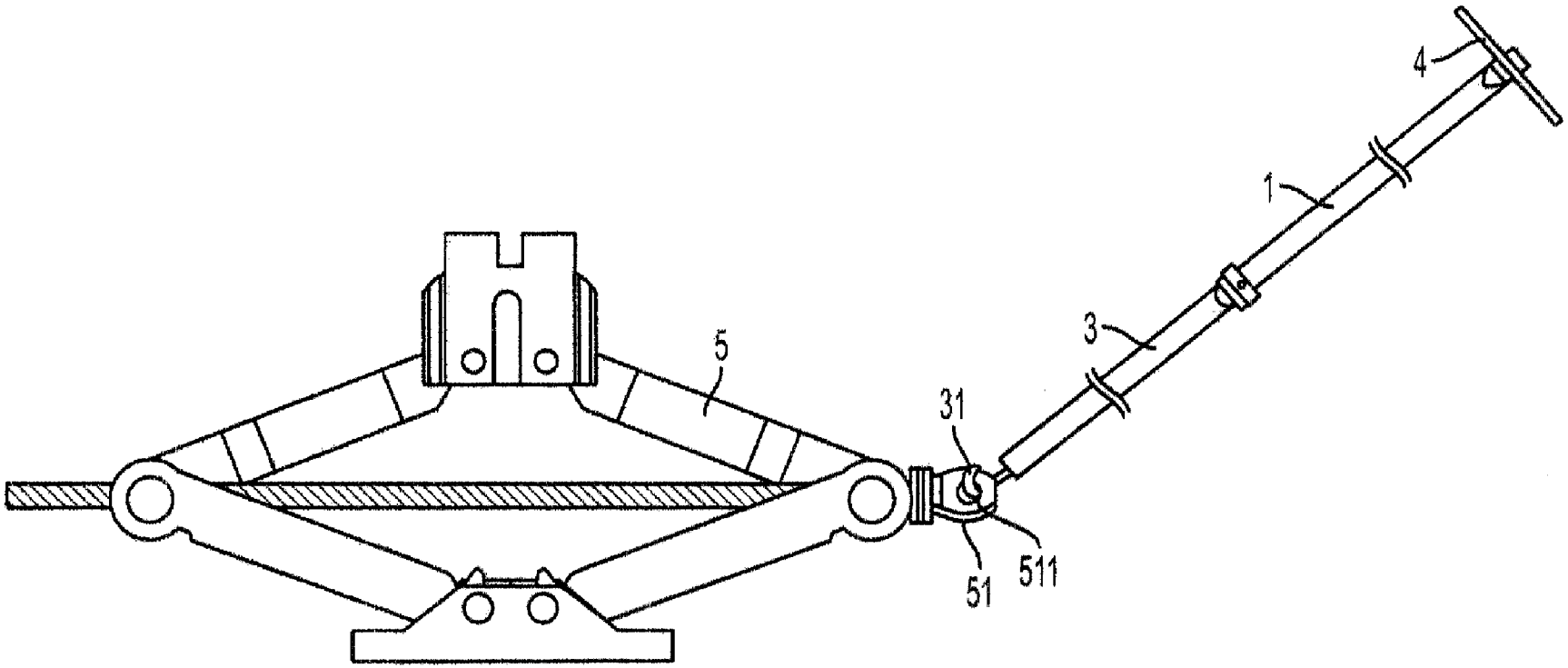
FIG. 7 is a schematic drawing of an example of the arm extension according to any of the first through fifth embodiments.
Figure 8:
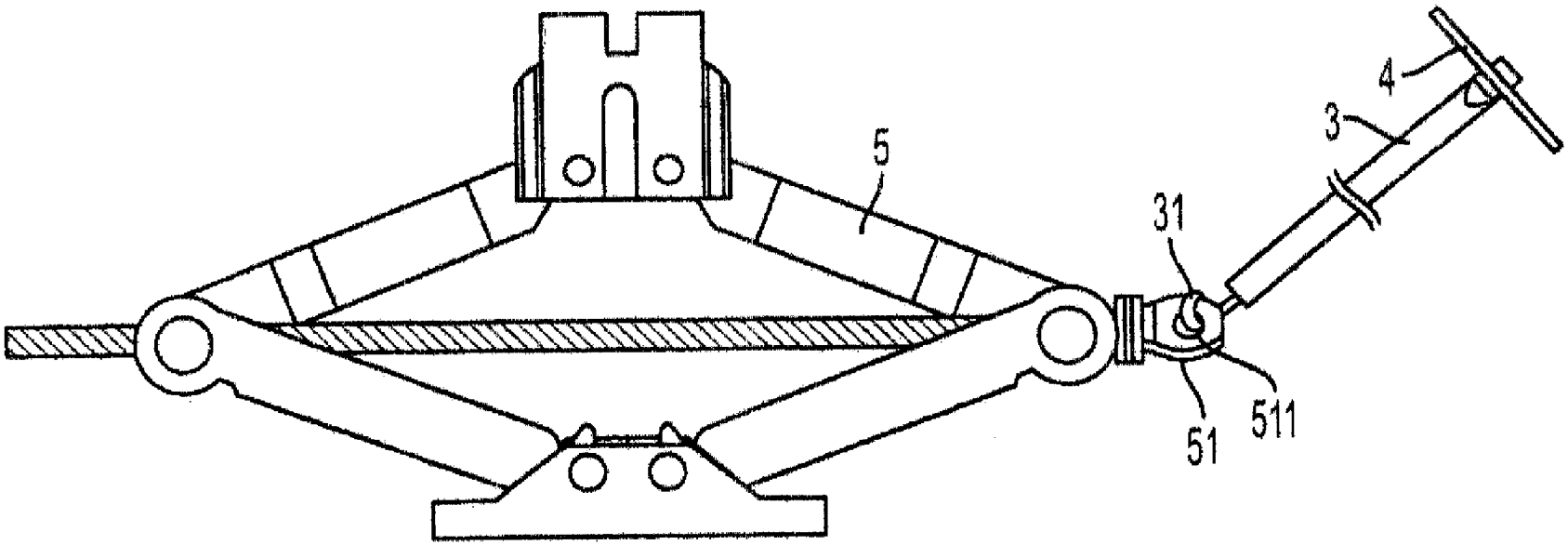
FIG. 8 PRIOR ART
FIG. 8 is a schematic drawing showing the operation of the jack arm according to the prior art.

A brief introduction to the operation of the present invention is provided with respect to FIG. 7. To use the jack 5, as the first step, the arm hook 31 at one end of the arm 3 is hooked up with the hook eye 511 on the screw head 51 of the jack 5, and the rectangular joint 32 at the other end of the arm 3 is inserted into the joint socket 112 of the first joint 11 on the connecting rod 1 as shown in any of the Embodiments 1 through 5 and is then locked by the lockup mechanism 2, so as to complete the connection between the arm 3 and the connecting rod 1; then, as the second step, the handle bar 4 is fixed with the second joint 12, and turned either clockwise or counterclockwise to drive the connecting rod 1, the arm 3 and the screw of the jack 5 to turn accordingly. Consequently, the jack 5 will either be lifted or restored to its original position. Because of the connection of the arm 3 with the connecting rod 1, the length of the arm 3 is extended, and as a result, during the whole process of operation, the operator can adopt a standing pose instead of a squatting pose. This benefits the convenience of the operation and reduces the working intensity of the operator. When the operation is finished, the connecting rod 1 can be disconnected from the arm 3, and stored easily for a next use.

The invention claimed is:

1. An extension rod for a jack arm comprising:

a connecting rod having an inner cavity and at least one joint formed at an end of the connecting rod;

at least one locking hole formed in the at least one joint; and a lockup mechanism comprising an elastic body configured to connect to either said at least one joint or said connecting rod through the at least one locking hole and a lockup bolt formed on said elastic body and configured to engage said at least one locking hole by passing from an outer surface of the connecting rod to the inner cavity of the connecting rod, wherein the cross sectional shape of both the first joint and the second joint is rectangular.

2. An extension rod for a jack arm comprising:

a connecting rod having an inner cavity and at least one joint formed at an end of the connecting rod;

at least one locking hole formed in the at least one joint; and a lockup mechanism comprising an elastic body configured to connect to either said at least one joint or said connecting rod through the at least one locking hole and a lockup bolt formed on said elastic body and configured to engage said at least one locking hole by passing from an outer surface of the connecting rod to the inner cavity of the connecting rod, wherein said elastic body comprises a spring steel sheet which is bent into a general clip shape, with a pair of first and second clipping arms capable of pressing on two side walls of said at least one joint, and said lockup bolt extends from a middle of an upper part of the elastic body and is insertable into said at least one locking hole.

3. An extension rod for a jack arm comprising:

a connecting rod having an inner cavity and at least one joint formed at an end of the connecting rod;

at least one locking hole formed in the at least one joint; and a lockup mechanism comprising an elastic body configured to connect to either said at least one joint or said connecting rod through the at least one locking hole and a lockup bolt formed on said elastic body and configured to engage said at least one locking hole by passing from an outer surface of the connecting rod to the inner cavity of the connecting rod, wherein said elastic body comprises a spring steel sheet shaped as a "T", with the base part of said "T" configured to attach to the connecting rod, and said lockup bolt extending from a front end of said "T" and being insertable into said at least one locking hole.

4. An extension rod for a jack arm comprising:

a connecting rod having an inner cavity and at least one joint formed at an end of the connecting rod;

at least one locking hole formed in the at least one joint; and a lockup mechanism comprising an elastic body configured to connect to either said at least one joint or said connecting rod through the at least one locking hole and a lockup bolt formed on said elastic body and configured to engage said at least one locking hole by passing from an outer surface of the connecting rod to the inner cavity of the connecting rod, wherein said elastic body comprises a spring steel wire which is bent into a clip shape, with ends of a first clipping arm and a second clipping arm pivotably fixed on the connecting rod, and said lockup bolt formed by bending at a front end of the elastic body and configured to engage said at least one locking hole.

5. An extension rod for a jack arm comprising:

a connecting rod having an inner cavity and at least one joint formed at an end of the connecting rod;

at least one locking hole formed in the at least one joint; and a lockup mechanism comprising an elastic body configured to connect to either said at least one joint or said connecting rod through the at least one locking hole and a lockup bolt formed on said elastic body and configured to engage said at least one locking hole by passing from an outer surface of the connecting rod to the inner cavity of the connecting rod, wherein said elastic body comprises a spring steel wire, with a rear end of the spring steel wire being fixed on the connecting rod and a front end of the spring steel wire being a free end; and said lockup bolt, in the form of a butterfly screw, is connected to said free end and insertable into said at least one locking hole.

6. An extension rod for a jack arm, comprising:

a connecting rod having at least one joint formed at an end of the connecting rod;

at least one locking hole formed in the at least one joint; and a lockup mechanism comprising an elastic body configured to connect to the at least one joint through the at least one locking hole and having a pair of first and second clipping arms capable of pressing on two side walls of the at least one joint when the elastic body is connected to the at least one joint, and a lockup bolt formed on the elastic body and configured to engage the at least one locking hole.

7. The extension rod of claim 6, wherein the at least one joint includes a first joint and a second joint formed at ends of the connecting rod, and the at least one locking hole includes a first hole formed in the first joint and a second hole formed in the second joint.

8. The extension rod of claim 7, wherein the diameter of said first joint is larger than that of the second joint.

9. The extension rod of claim 7, wherein said first and second locking holes are round holes.

10. The extension rod of claim 6, wherein said elastic body comprises a spring steel wire which is bent into a clip shape, and said lockup bolt is formed by bending the wire in a middle of an upper part of the elastic body and is insertable into said at least one locking hole.

* * * * *